US008076853B1

(12) United States Patent
Caryotakis

(10) Patent No.: US 8,076,853 B1
(45) Date of Patent: Dec. 13, 2011

(54) TERAHERTZ SHEET BEAM KLYSTRON

(75) Inventor: George Caryotakis, Palo Alto, CA (US)

(73) Assignee: Communications & Power Industries LLC, Palo Alto, CA (US)

( * ) Notice: Subject to any disclaimer, the term of this patent is extended or adjusted under 35 U.S.C. 154(b) by 954 days.

(21) Appl. No.: 12/074,558

(22) Filed: Mar. 3, 2008

Related U.S. Application Data

(60) Provisional application No. 60/904,536, filed on Mar. 1, 2007.

(51) Int. Cl.
*H01J 25/10* (2006.01)

(52) U.S. Cl. ..... 315/5; 315/5.39; 315/500

(58) Field of Classification Search ..... 315/500, 315/504, 502, 503, 501, 5, 5.11, 5.12, 5.39, 315/5.41, 5.42, 5.43, 5.38
See application file for complete search history.

(56) References Cited

U.S. PATENT DOCUMENTS 6,326,730 B1 * 12/2001 Symons ..... 315/5.39
6,486,605 B1 * 11/2002 Beunas et al. ..... 315/5.35
7,898,193 B2 * 3/2011 Miller et al. ..... 315/505

FOREIGN PATENT DOCUMENTS

WO 0030145 5/2000

OTHER PUBLICATIONS

Shin, Young-Min et al., "Novel Coupled-Cavity TWT Structure Using Two-Step LIGA Fabrication," IEEE Transactions on Plasma Science, vol. 31, No. 6, Dec. 2003, pp. 1317-1324.
Scheitrum, G. et al., "W-Band Sheet Beam Klystron Design," Gyro-Devices and other Vacuum Electronic Devices, 2004, pp. 525-526.
Carlsten, Bruce E. et al., "Technology Development for a mm-Wave Sheet-Beam Traveling-Wave Tube," IEEE Transactions on Plasma Science, vol. 33, No. 1, Feb. 2005, pp. 85-93.
Garcia-Garcia, Joan et al., "Optimization of Micromachined Reflex Klystrons for Operation at Terahertz Frequencies," IEEE Transactions on Microwave Theory and Techniques, vol. 52, No. 10, Oct. 2004, pp. 2366-2370.
International Search Report and Written Opinion, Application No. PCT/US2008/002841, dated Oct. 7, 2008.

* cited by examiner

*Primary Examiner* — David Hung Vu
(74) *Attorney, Agent, or Firm* — Nixon Peabody LLP

(57) ABSTRACT

A terahertz sheet beam klystron (TSBK) includes an electron gun configured to generate a sheet electron beam and a drift tube through which the sheet beam is propagated. The drift tube is provided with multiple resonant cavities and includes a drift tube circuit including an input RF circuit through which an input RF signal is introduced and an output RF circuit through which an output RF signal is extracted, a collector, and a vacuum envelope. The output RF circuit is configured such that $Q_e$ (extraction Q) of the drift tube circuit is comparable to $Q_0$ (unloaded Q) of the drift tube circuit, thereby improving the efficiency of the drift tube circuit.

15 Claims, 2 Drawing Sheets

TERAHERTZ SHEET BEAM KLYSTRON

CROSS-REFERENCE TO RELATED APPLICATIONS

This application claims the benefit of U.S. provisional patent application No. 60/904,536, filed on Mar. 1, 2007, entitled "Terahertz Sheet Beam Klystron."

FIELD OF THE INVENTION

This invention relates to devices for radio frequency power generation in the Terahertz ($300\times10^9$ through $10{,}000\times10^9$ Hertz) frequency band.

BACKGROUND

The so-called "Terahertz Gap", between 0.3 to 10 THz, is a frequency range where a plethora of potential important applications exist, while there is a paucity of sufficiently powerful sources to exploit these applications. Opportunities in the use of terahertz radiation exist in basic science, in medicine and in the government sectors of the economy. Transportability may be an important requirement, given some of the military uses of terahertz power.

The obstacles that have stood in the way of developing practical terahertz sources have been the fundamentally low efficiency and output power of the solid-state devices that have been employed to date to produce terahertz radiation in portable or practically transportable systems. Although quantum cascade devices have been extended from the near-infrared region to somewhat less than 2 THz, issues exist, including how far below 2 THz they may operate and whether cryogenic temperatures are required for high performance. Existing portable solid state-based devices are limited in power, which is typically on the order of milliwatts. On the other hand, the size and cost and power requirements of FEL (free electron laser) or laser-based terahertz sources, which may provide hundreds or even thousands of watts of power, are, in most cases, prohibitive for the intended use.

An alternative to solid-state devices and photonic devices are conventional microwave tubes. These are available as oscillators only, but the average power they produce measures well below 1 watt. Problems with these devices are the removal of waste heat from the small areas where it has to be generated, and the formation and confinement of a beam with sufficient current, given that the beam cross-section area is proportional to the square of the wavelength. In addition, the fabrication of the RF (radio frequency) interaction structures required presents increasingly serious difficulties with decreasing wavelength.

BRIEF SUMMARY OF THE INVENTION

As described herein, a terahertz sheet beam klystron (TSBK) including an electron gun configured to generate a sheet electron beam, a drift tube through which the sheet beam is propagated, the drift tube having multiple resonant cavities and comprising a drift tube circuit including an input RF circuit through which an input RF signal is introduced and an output RF circuit through which an output RF signal is extracted, a collector, and a vacuum envelope, wherein the output RF circuit is configured such that $Q_e$ (extraction Q) of the drift tube circuit is comparable to $Q_0$ (unloaded Q) of the drift tube circuit, thereby improving the efficiency of the drift tube circuit.

Also described herein is a method for generating or amplifying RF power using a terahertz sheet beam klystron (TSBK) in which an electron gun generates a sheet beam that is transported through a drift tube and series of cavities, the method including overloading the output cavity. The TSBK has a conversion efficiency that is reduced in favor of an increased output cavity efficiency. The output cavity overloading results in decreased output cavity voltage, making extensive collector depression feasible and recovering the unused power in the beam.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

In the drawings.

DETAILED DESCRIPTION OF THE INVENTION

The description herein is provided in the context of a terahertz and near terahertz RF power generation system. Those of ordinary skill in the art will realize that the following detailed description is illustrative only and is not intended to be in any way limiting. Other embodiments will readily suggest themselves to such skilled persons having the benefit of this disclosure. Reference will now be made in detail to implementations as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 3:
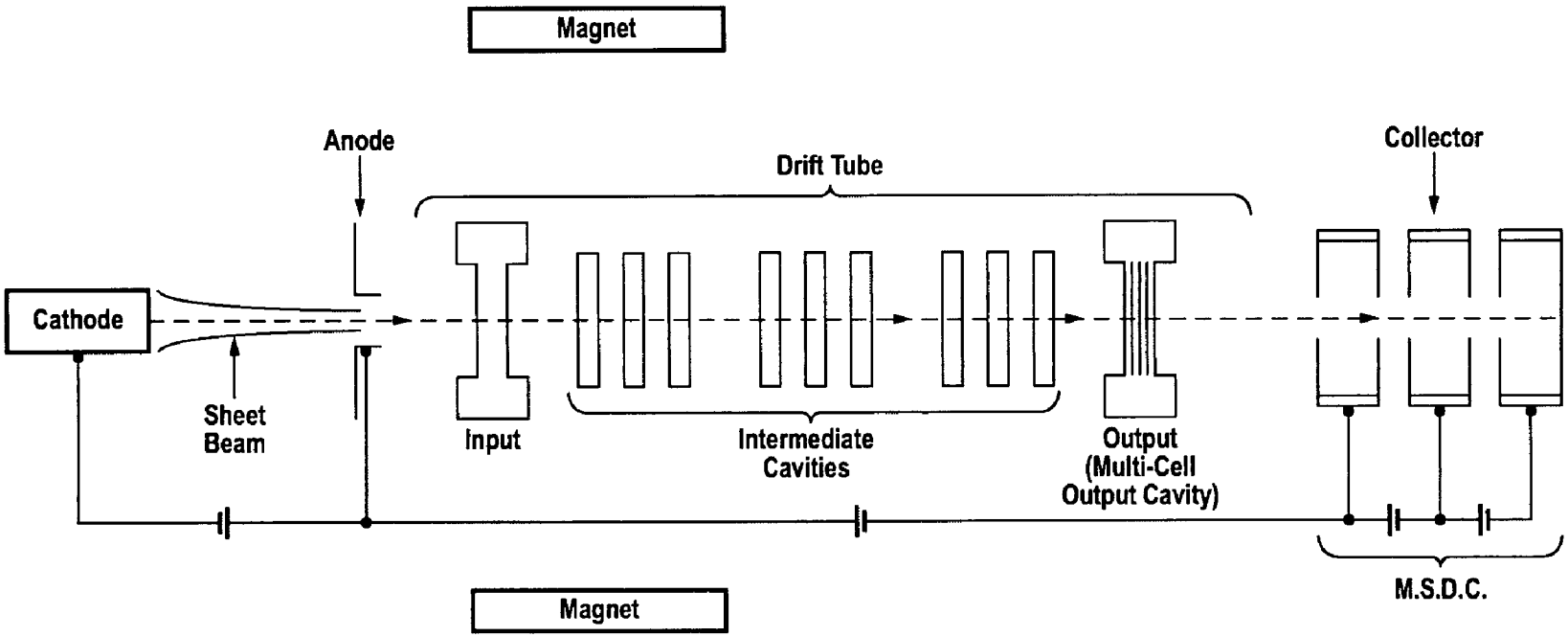
FIG. 3 is a schematic diagram of the TSBK device.

The Sheet Beam Klystron (SBK) can be described as an overmoded klystron, but one with a plane geometry that allows the use of "LIGA" (German acronym for X-ray lithography (X-ray Lithographie), Electroplating (Galvanoformung), and Molding (Abformung)), a relatively new photolithographic fabrication method, useful in fabricating structures for use in the terahertz and near terahertz frequency band. A schematic diagram of an SBK is provided in FIG. 3. The design approach involves sacrificing electronic efficiency (the efficiency of converting the kinetic energy of the modulated beam into RF) in favor of an increased circuit efficiency. These two efficiencies present a "zero sum" problem to the designer. A high conversion efficiency requires an output circuit RF impedance comparable to the DC (direct current) impedance of the beam, which for a terahertz klystron will be several thousand ohms. However, at terahertz frequencies the "$Q_0$" (unloaded Q) of the output cavity is only a few hundred ohms because of high skin losses. (The factor Q provides an indication of the ratio of energy stored to energy dissipated in the device.) The circuit efficiency (defined as $Q_0/[Q_0+Q_e]$) will be very low if the output circuit impedance is optimized for maximum conversion efficiency (high $Q_e$). The design approach is therefore to intentionally overload the output circuit with a low $Q_e$, comparable to $Q_0$, and to recover the unused beam power with a deeply depressed collector (which may be a multi-stage depressed collector or MSDC), which is made possible by the fact that the RF voltage at the output cavity of the SBK will be very low because of the overcoupling. The collector may be depressed to about 97% of cathode potential. The MSDC may be powered separately from the other stages of the device. Liquid cooling of the drift tube and/or other components may be necessary.

Figure 1:
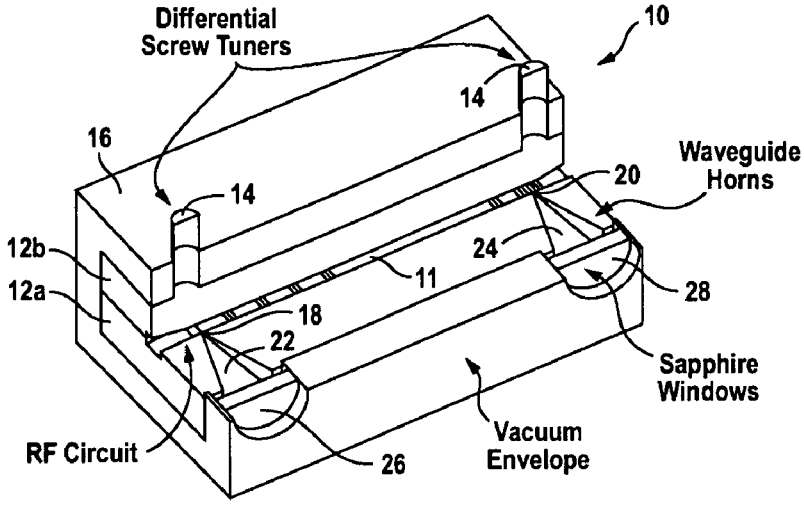
FIG. 1 is an isometric partial cut-away view of the cavity block defined by a drift tube and a number of cavities.
Figure 2:
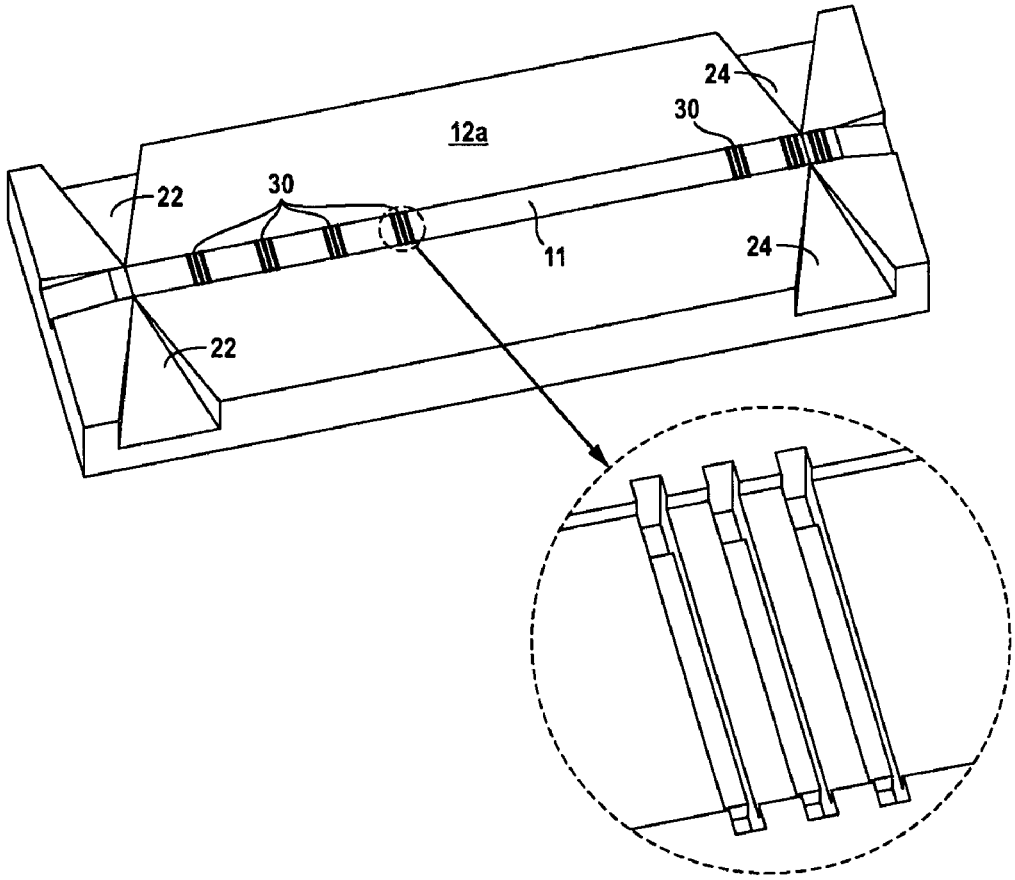
FIG. 2 is an isometric view of a lower portion of the of the cavity block (one half) showing cavity details in insert.

In accordance with one embodiment, the core 10 of a Terahertz SBK (TSBK) is shown in FIGS. 1 and 2. It includes a copper insert including two essentially identical halves 12*a*, 12*b* (the top half is shown transparent in FIG. 1 to show the cavities) on which the TSBK drift tube 11 and cavities 30 are formed with the LIGA or similar process. The two halves 12*a*, 12*b* are separated by a few microns and the distance between them is adjusted to tune the resonant frequencies of the TSBK cavities. This mechanical tuning may be accomplished in one embodiment with 4 pistons 14 attached to the two ends of each copper LIGA piece 12*a*, 12*b*. These may be in turn connected to bellows (not shown) to seal a vacuum inside a stainless steel outer shell 16. Outside the vacuum, the pistons may be moved with differential screws or piezoelectric actuators (not shown) to adjust the operating frequency of the TSBK. On the opposite side of the copper LIGA pieces 12*a*, 12*b*, channels (not shown) for water or other fluid can be machined to cool the two copper blocks (inlets and outlets may be made flexible and sealed to the shell to maintain vacuum). In one embodiment, there are provided two input (18) and two output (20) waveguides, to preserve symmetry in the RF circuits and avoid the excitation of parasitic modes. The waveguides are connected to (machined) antenna horns 22, 24, which face quartz or sapphire windows 26, 28 sealed to the stainless steel shell 16, with corresponding horn antennas on the air side (not shown). Quasi-optical power combining methods may be used to provide a single input and output port. This quasi-optical transmission of input and output power, using horn antennas 22, 24, and (relatively) large disk windows 26, 28 sealed to the stainless steel vacuum envelope is preferable to attempting to create vacuum tight block windows inside a waveguide, as in the case of the WSBK. The RF losses involved will be relatively minor.

The electron gun, which includes the cathode (FIG. 3) may be attached on the left side of the shell and the collector on the right. In one embodiment, a magnet (permanent or otherwise) is employed to confine the sheet beam. A magnet allows "confined flow" with flux threading the cathode, producing a stiff, largely ballistic beam. The electron gun may have a convergence of about 20:1 in one dimension only. It provides a long "throw" allowing the beam to converge over some distance, following the magnetic field until they become parallel over the length of the drift tube. Alignment of electron gun and magnetic field may be accomplished by accurately locating on the vacuum envelope the two iron polepieces which shape the field inside the permanent magnet.

The cavities 30 are sections of waveguides operated at their cutoff frequency. This provides an electric field oriented in the direction of the beam (FIG. 3), which is flat across the web of the beam and ensures that electron bunching occurs uniformly across the web of the beam. There are four relevant electrical parameters in the design of the SBK cavity: the operating resonant frequency, the R/Q (a measure of the field developed across the interaction gap, where R is impedance and Q is the quality factor as described above), the coupling coefficient to the beam, and the total cavity Q, which accounts for all losses, internal and external. These parameters combine to produce an overall cavity impedance that is presented to the electron beam driving the cavity. A voltage is developed across the interaction gap, which further modulates the beam. A number of cavities can be used, and gains can be very high. The coupling coefficient of a single-cell cavity, such as the first cavity, will be low, but can be improved by "extending" the cavity, i.e., by adding more cells. These may be coupled together through the electric fields extending into the drift tube and, if the cell spacing is synchronized with the beam velocity, coupling to the beam is enhanced and the gain improves. FIG. 2 shows a 7-cell output (the cavities are demarcated 30), which may be necessary in order to divide the total voltage developed to extract energy from the beam among several interaction gaps and reduce electric field gradients.

In one embodiment, the RF circuit and collector may be water (or other fluid) cooled. Cooling channels may be formed, for instance with wire EDM (Electrical Discharge Machining). Multiple channels may run the length of the RF circuit although most of the heat transfer will occur at the output cavity. The cooling channels may be closed by diffusion bonding a thin copper plate on top of the EDM's channels. Each circuit half may be cooled with an independent circuit with a plenum at each end.

In one example embodiment, described below, parameters resulting from a simulation of the 600-GHz (0.6 THz) "TSBK" are as set forth in TABLE 1. They assume a very high depressed collector efficiency because of the low output cavity voltage (880 volts).

TABLE 1

| | |
|---|---|
| Beam Voltage: | 40,000 volts |
| Beam current: | 200 mA |
| Output power: | 27 watts (CW) (continuous wave) |
| Electronic efficiency: | 0.5% |
| Circuit efficiency: | 65% |
| Collector efficiency: | 97% |
| Overall efficiency: | about 8% |

The above are exemplary modes of carrying out the invention and are not intended to be limiting. It will be apparent to those of ordinary skill in the art that modifications thereto can be made without departure from the spirit and scope of the invention as set forth in the following claims.

What is claimed is:

1. A terahertz sheet beam klystron (TSBK) comprising:

an electron gun configured to generate a sheet electron beam;

a drift tube through which the sheet electron beam is propagated, the drift tube leading to multiple resonant cavities including an input RF cavity through which an input RF signal is introduced and a multi-cell output cavity through which an output RF signal is extracted;

a collector; and a vacuum envelope, wherein an output RF circuit of the drift tube is configured such that $Q_e$ (extraction Q) of a drift tube circuit is comparable to $Q_0$ (unloaded Q) of the drift tube circuit, thereby improving the efficiency of the drift tube circuit.

2. The TSBK of claim 1, wherein the drift tube includes an input power coupling at a first end and output power coupling at a second end.

3. The TSBK of claim 2, wherein at least one of the input or output power coupling is quasi-optical and includes transmission of power through horn antennas and through a window formed in the vacuum envelope.

4. The TSBK of claim 2, wherein at least one of the input or output power coupling is symmetrically disposed at opposite sides of the rectangular waveguide.

5. The TSBK of claim 2, wherein the drift tube includes first and second copper blocks formed by a LIGA process.

6. The TSBK of claim 1, further comprising one or more permanent magnets for shaping the electron beam in the drift tube.

7. The TSBK of claim 1, wherein the drift tube is liquid-cooled.

8. The TSBK of claim 1, wherein the collector is a multi-stage depressed collector (MSDC).

9. The TSBK of claim 8, wherein each stage of the MSDC is powered separately from the other stages.

10. A terahertz sheet beam klystron (TSBK) comprising:

an electron gun configured to generate a sheet electron beam;

a drift tube through which the sheet beam is propagated, the drift tube leading to multiple resonant cavities and comprising an input cavity through which an input RF signal is introduced and a multi-cell output cavity through which an output RF signal is extracted;

a collector; and a vacuum envelope, wherein a drift tube circuit has a conversion efficiency that is reduced in favor of increased output cavity efficiency, said reduction resulting in decreased output voltage, and wherein the collector is depressed such that unused beam power is efficiently recovered.

11. A method for generating or amplifying RF power using a terahertz sheet beam klystron (TSBK) in which an electron gun generates a sheet beam that is propagated through a drift tube characterized by a drift tube circuit, the method comprising:

overloading the TSBK such that the drift tube circuit has a conversion efficiency that is reduced in favor of increased drift tube circuit efficiency, said reduction resulting in decreased output voltage; and depressing the collector sufficiently to recover unused beam power.

12. A TSBK (terahertz sheet beam klystron) RF power generator/amplifier, comprising:

an electron gun configured to generate a sheet electron beam;

a drift tube through which the sheet beam is transported, the drift tube leading to multiple resonant cavities and comprising an input cavity through which an input RF signal is introduced and a multi-cell output cavity through which an output RF signal is extracted;

a collector; and a vacuum envelope, wherein an output RF circuit of the drift tube is configured such that $Q_e$ (extraction Q) of a drift tube circuit is comparable to $Q_0$ (unloaded Q) of the drift tube circuit, thereby improving the efficiency of the drift tube circuit.

13. A drift tube for a terahertz sheet beam klystron (TSBK) comprising:

a first copper block;

a second copper block, the first and second copper blocks defining a rectangular waveguide therebetween, said waveguide including an input power coupling at a first end and output power coupling at a second end; and a plurality of resonant cavities, wherein the drift tube provides a drift tube circuit including an input RF circuit through which an input RF signal is introduced and an output RF circuit through which an output RF signal is extracted, and wherein the output RF circuit is configured such that $Q_e$ (extraction Q) of the drift tube circuit is comparable to $Q_0$ (unloaded Q) of the drift tube circuit, thereby improving the efficiency of the drift tube circuit.

14. A TSBK (terahertz sheet beam klystron) RF power generator/amplifier, comprising:

an electron gun configured to generate a sheet electron beam;

a drift tube through which the sheet beam is transported, the drift tube having multiple resonant cavities and comprising a drift tube circuit including an input RF circuit through which an input RF signal is introduced and an output RF circuit through which an output RF signal is extracted;

a collector; and a vacuum envelope, wherein the output RF circuit is configured such that $Q_e$ (extraction Q) of the drift tube circuit is comparable to $Q_0$ (unloaded Q) of the drift tube circuit, thereby improving the efficiency of the drift tube circuit, wherein TSBK is configured to generate an output power of at least about 20 watts (cw).

15. A TSBK (terahertz sheet beam klystron) RF power generator/amplifier having a drift tube circuit and a collector, said TSBK comprising:

means for overloading the TSBK such that the drift tube circuit has a conversion efficiency that is reduced in favor of increased drift tube circuit efficiency, said reduction resulting in decreased output voltage; and means for depressing the collector sufficiently to recover unused beam power.

* * * * *